United States Patent [19]

Scheja

[11] Patent Number: 4,662,147

[45] Date of Patent: May 5, 1987

[54] DEVICE FOR MAKING AS WELL AS FILLING OF BAGS

[75] Inventor: Erich Scheja, Leinfelden-Echterdingen, Fed. Rep. of Germany

[73] Assignee: ABG Apparatebau-Gesellschaft mbH, Leonberg, Fed. Rep. of Germany

[21] Appl. No.: 756,960

[22] Filed: Jul. 18, 1985

[30] Foreign Application Priority Data

Jul. 24, 1984 [DE] Fed. Rep. of Germany ..... 3427168

[51] Int. Cl.[4] ..... B65B 61/00

[52] U.S. Cl. ..... 53/137; 53/562; 53/563; 53/384

[58] Field of Search ..... 53/137, 381 R, 384, 53/385, 386, 561, 562, 563, 578, 55, 455; 493/200, 201, 233, 248, 302

[56] References Cited

U.S. PATENT DOCUMENTS

| | | | |
|---|---|---|---|
| 3,319,538 | 5/1967 | Bodalay | 53/562 X |
| 3,545,166 | 12/1970 | Johnson et al. | 53/386 X |
| 3,599,388 | 8/1971 | Feingold | 53/562 X |
| 3,744,211 | 7/1973 | Titchenal et al. | 53/384 X |
| 3,779,449 | 12/1973 | Membrino | 53/385 X |
| 3,930,350 | 1/1976 | Reid | 53/562 X |
| 4,055,109 | 10/1977 | Kan | 493/201 X |
| 4,174,597 | 11/1979 | Mowli et al. | 53/455 X |
| 4,205,504 | 6/1980 | Gregoire et al. | 53/562 X |
| 4,290,467 | 9/1981 | Schmidt | 53/455 X |
| 4,334,399 | 6/1982 | Onishi | 53/385 X |
| 4,494,362 | 1/1985 | Koch | 493/302 X |
| 4,514,962 | 5/1985 | Ausnit | 53/384 X |

FOREIGN PATENT DOCUMENTS

| | | | |
|---|---|---|---|
| 2226466 | 12/1973 | Fed. Rep. of Germany | 53/562 |
| 1040506 | 12/1953 | France | 53/562 |

*Primary Examiner*—John Sipos
*Assistant Examiner*—Steven P. Weihrouch
*Attorney, Agent, or Firm*—Michael J. Striker

[57] ABSTRACT

At first, a semihose is made with a label fold (2) as well as a bag fold (3), whose free ends overlap with each other, whereby the free edge of the bag fold (3) is disposed on the outside. The labels 6 which are inserted in the longitudinal direction of the semihose control the forward movement of the semihose within the device in such a manner that separating weld seams (4) as well as adjacent perforations (5) are always made between successive labels (6). A sealing weld seam (7) is made after filling the bag, so as to close the bag.

10 Claims, 6 Drawing Figures

DEVICE FOR MAKING AS WELL AS FILLING OF BAGS

Figure 1:
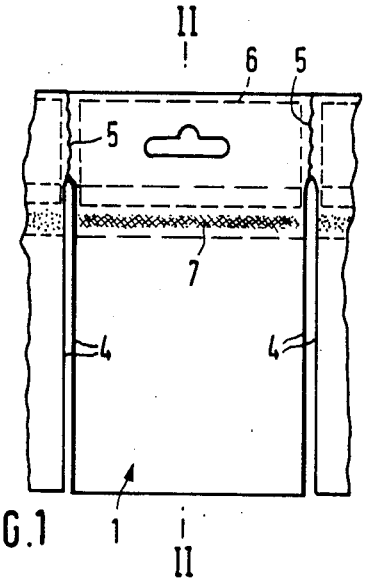

The invention relates to a device for making as well as filling of bags being provided with preferably stiff label strips being made from a semihose of a plastic foil in that the same is separated transversely to its stretch by means of separating welding means which are provided by means of corresponding weld dies at the initially open side of the semihose and after filling it is closed with a seal weld into a closed bag by means of corresponding seal weld dies.

Corresponding devices are commercially available. However the economy of the known devices are unsatifactory insofar that a relative expensive effort is required for mounting the labels.

Partially the labels are mounted manually on already filled bags, in that a roof shaped folded strip of carton, which is provided with indicia, is folded over a bag edge and is mounted thereon by means of staples. If the filler material of the bag has a large weight and if the bag is suspended from a hook through the opening in the label for sales presentation, or the like, the bag has a slight unsightly appearance, because the weight of the filler material tries to detach the bag from the mounting staples on the label.

It is also known to weld such roof shaped carton strips mechanically with the already filled bags by heating a plastic coating being present on the inside of the carton fold. However, for this purpose comparably expensive special cartons are required, because the heating of the plastic coating for welding the cartons with the bags must be performed through the corresponding heat resistant carton.

Moreover, devices exist which insert a label into the bag after the bag has been made with one open side and thereafter weld the bags with each above the label by shortening the bag, so that the label is enclosed completely by the foil which forms the label and cannot be lost. Thereafter, the goods to be packaged is filled into the bag and the bag opening is closed by a seal welding. This device can hardly be adjusted to different bag sizes, because the labels must be inserted differently far into the bag with different long bags and the sealing seam which separates the label receiving space from the remainder of the bag must be mounted in a correspondingly different distance from the bag opening. In addition, the sealing seam must be made with great care, so as to avoid that filler material which is introduced into the bag in the subsequent filling operation can get into the label receiving space.

It is therefore an object of the invention to provide a device which permits to make bags with labels from any given materials, in particular normal carton, in a particularly simple manner, whereby an adjustment of the device for different bag sizes should be made easily possible.

This object is solved in that by means of a mold shoulder, which is part of the device for making the edge strips, a web of foil being pulled over this mold shoulder by forming two U-folds which overlap with each other by being foldable with their free edges, that the labels are insertable by means of a label feeding member synchronous with the lead of the semihose, being moved along the feeding path, through the end opening of the foil web of this semihose and into the one fold (label fold) being covered on the outside by the free edge of the other fold (bag fold), and that the separating weld seams which have to be provided behind each inserted labels by means of the separating well die extending over the total width of the bag fold into an area of the label fold between two succesive labels, however by leaving a clearance of a partial width on the label fold.

In accordance with the invention the bag fold laterally with respect to the feeding direction may have any given measurements without having an influence on the feeding of the labels, because the label is always introduced at the same location.

Moreover, a web of bags is formed during the manufacturing of the bags, in that adjacent bags are connected with each other in a web like fashion by a partial area of the label fold. The labels which are disposed in the label fold stiffen the web like connection stewise at a length corresponding to about the movement of the bag opening in the forward moving direction. Thereby the web of bags is provided with a chain like structure by means of the relative stiff chain members formed by the labels which are flexibly connected with each other over the mentioned partial areas.

In accordance with a preferred embodiment it is provided that the separating weld dies operate synchronously with perforation dies or knives being disposed as a continuation of the separating weld dies in the area of the partial width clearance of the bag fold being free from the separating weld dies for making lineal like perforations which is a continuation of the separating weld seams. This perforation has no influence on the handling of the web of bags, however it later facilitates the separation form the web of bags.

Advantageously, the label feeding member is so designed or disposed that the labels are displaceable by means of the label feeding member from a position outside of the semihose into a tranfer position within the semihose, from which the labels are being taken along by means of a friction locking with the label fold during the forward moving of the semihose. Therefore, no special measures for retaining the labels in the label fold are required.

In a constructive particularly simple manner a trough may be provided encompassing a lable edge serving as the label feed member, wherein the labels are displaceable into the transfer position by means of a trough parallel guided plunger.

In accordance with a particular preferred embodiment of the invention device a light barrier is provided in the feeding direction behind the transfer position as a part of a control of controlling the cycle like forward movement of the semihose in such a manner that the forward movement is interrupted when releasing the light barrier after the passing of the rear edge of a label in the forward movement by controlling the separating weld dies for making the separating weld seams and is again switched on during the successive renewed interruption of the light barrier by the first edge of the following label being pushed in forward direction into the transfer position. With this type of the forward moving control the measurement of the bags in the forward moving direction is automatically adjusted to the corresponding measurements of the labels. No measures are required for adjusting the device.

At a filling station which serves to fill the bags being disposed in the forward moving direction behind the separating welding dies the label fold is fed on a curved path with a curve center being disposed at the side facing the free edges of U-folds in such a manner that the path guiding elements press the free edge of the label folder against the labels transversely to the moving direction without gripping the free edge of the bag fold which lifts off the free edge of the label fold due to the path curvature.

In an advantageous design a blower may be disposed on the filling station with a blow direction away from the label fold against the free edge of the bag fold, so as to forcibly maintain the edge of the bag fold in the lift off position into which the blower flow tries to blow up the bag.

Figure 2:
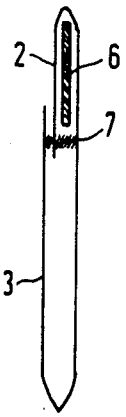
Figure 5:
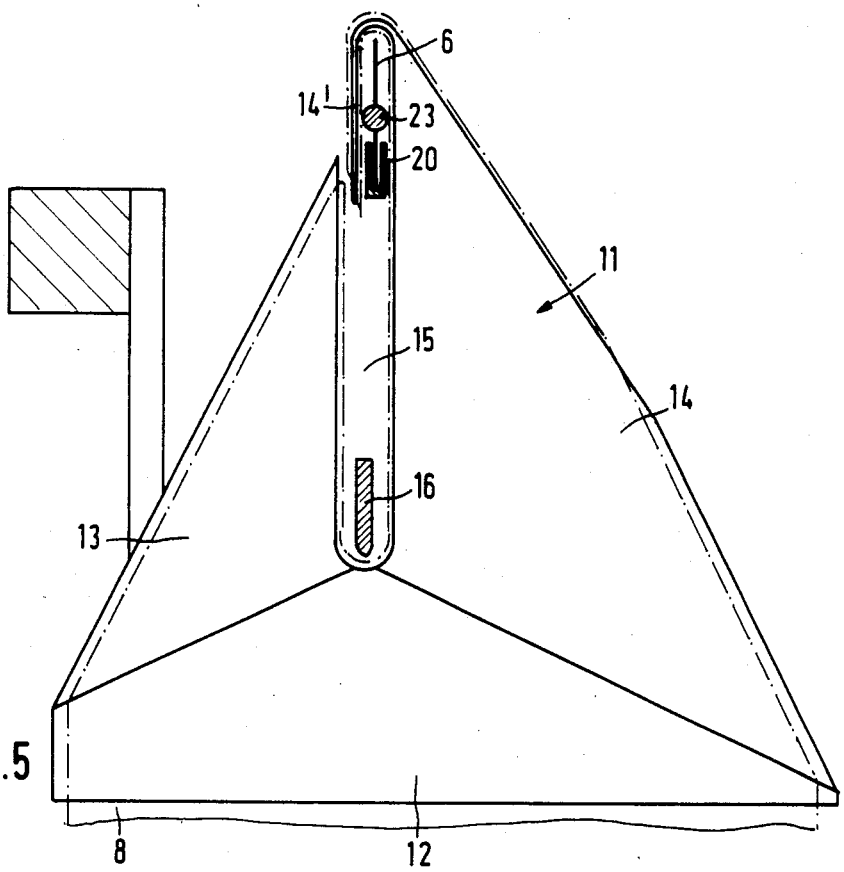
Figure 3:
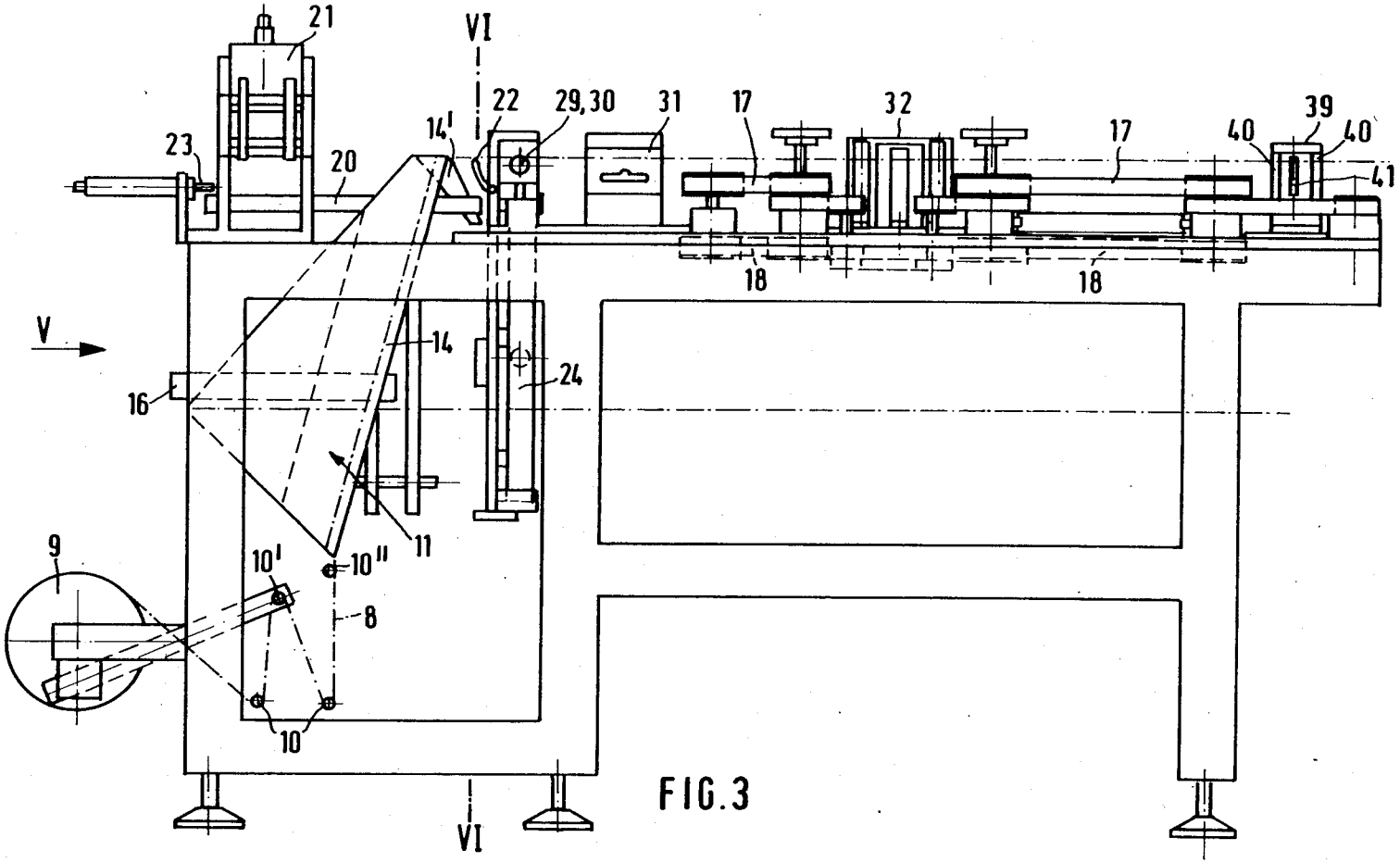
Figure 4:
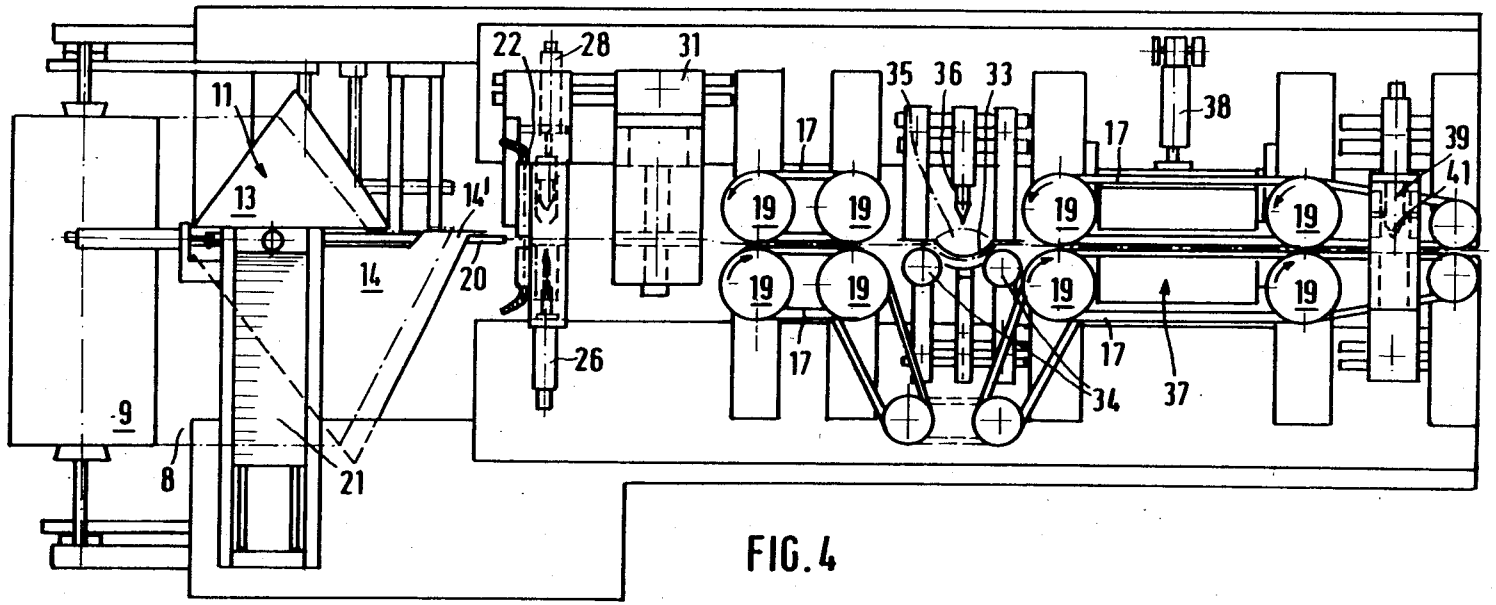
Figure 6:
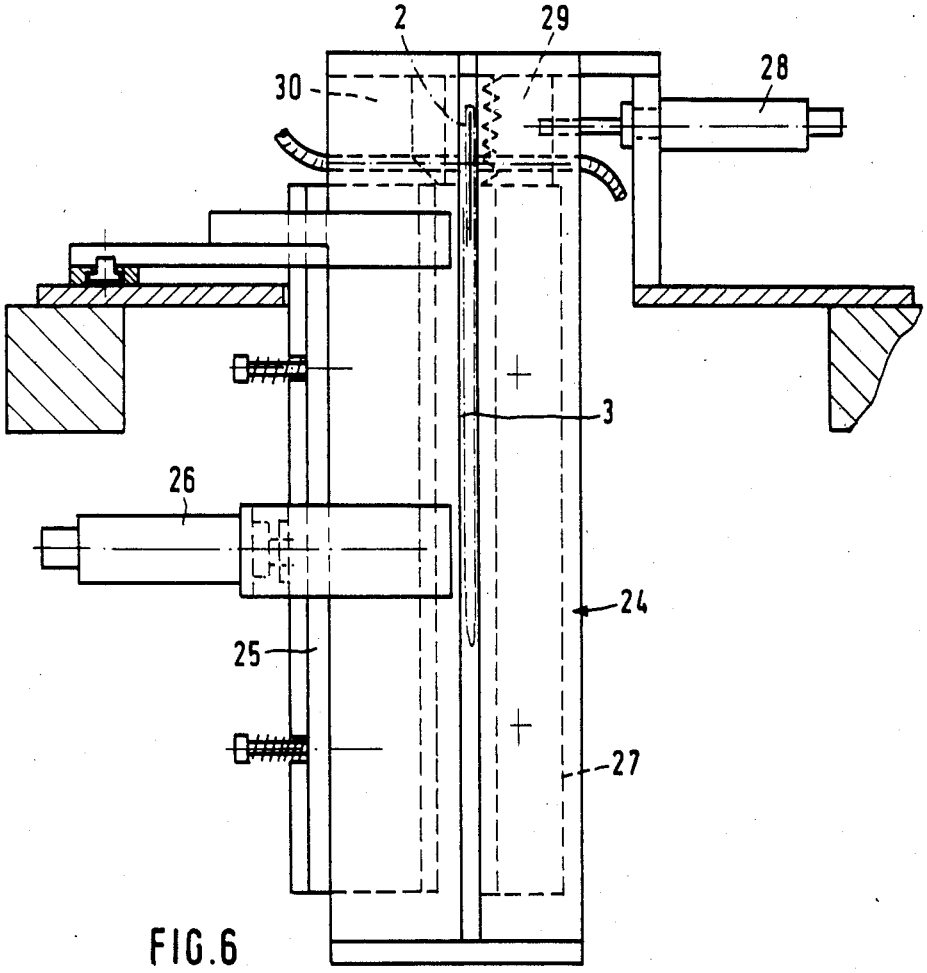

Moreover, we would like to make reference to the claims as well as the following description concerning advantageous embodiments, wherein the invention is explained in conjunction with a specially preferred exemplified embodiment illustrated in the drawings. The drawings show:

FIG. 1 a sideview of the web of bags to be made,

FIG. 2 a sectional view of the bags corresponding to sectional line II—II in FIG. 1, FIG. 3 a side view of the device, FIG. 4 a plan view of the device, FIG. 5 a view of the mold shoulder corresponding to the arrow V in FIGS. 3 and 4, and FIG. 6 a sectional view of the device corresponding to the sectional plane VI—VI in FIG. 3 for illustrating the separating weld dies.

The bags 1 illustrated in FIGS. 1 and 2 consist of a foil whose edges are folded over by forming a semihose in such a manner that a first fold 2 (label fold) as well as a second larger fold 3 (bag fold) are formed with overlapping edges, whereby the free edge of the bag fold 3 is mounted on the outside on the free edge of the lable fold 2. Separating seams 4 serve as separators for bags 1 extending over the total bag fold 3 as well as an adjacent partial area of the label fold 2 and thereby connecting the front and rear sides of the folds 2, 3 of each bag, but separating adjacent bags from each other.

The separating weld seams 4 continue in linear like disposed perforations 5 which facilitate a tearing of the area of the label fold 2 connecting the bag 1.

A label 6 made of carton, or the like, is accommodated in the label fold 2 of each bag being held in their positions by friction locking on the separating weld seams 4 which encompass two opposite corners of the labels 6, on the one hand, as well as by a seal weld seam 7 which runs in close proximity below the label transversely to the separating weld seams 4 connecting the free edges of folds 2 and 3 as well as the opposite common side of these folds. If need be, it is also sufficient if the seal weld seam 4 is disposed in close proximity below the free edge of the label fold, thus merely connecting the opposite sides of the bag fold 3 with each other. In any case, the seal weld seam 7 seals the bag fold 3 in FIGS. 1 and 2 tooward the upper side, so that filler goods (not illustrated) which is received in the bag fold 3, which had been introduced prior to the making of the seal weld seam 7, is safely encapsulated.

The bags 1 are made from a plastic foil 8 which in the inventive device illustrated in FIGS. 3 and 4 are wound up on a roller 9. The plastic foil 8 moves at first over guide rollers 10, whereby roller 10' is yieldingly mounted, so that the roller 9 can be wound off with a constant speed, although the plastic foil 8 moves intermittently through the device.

For forming the semihose with the cross section illustrated in FIG. 2, the foil 8 is pulled over a mold shoulder device 11. This essentially consists of three pyramide like disposed guide faces 12 to 14. Thereby, the lateral guide faces 13 and 14 are disposed in such a manner that their front edges, in FIG. 3, leave a free slot 15 therebetween, as can be seen from FIG. 5. Moreover, the end piece 14' of the guide face 14 is folded over in a U-shaped manner, so that its free end in the view of FIG. 5 is disposed within slot 15 and is directed obliquely downward to the right in accordance with FIG. 3.

The foil 8 moves from the last guide roller 10'' in transport direction over the lower guide face 12 on which the foil 8 is areally mounted. The two side faces of the foil also are mounted areally on the guide faces 13 and 14, whereby the side edge being areally mounted on guide face 14 is also areally mountd of end piece 14, illustrated on the left side of FIG. 5. When the side edges of the foil are mounted in the aforementioned manner on the guide faces 13 and 14 or the end piece 14', respectively, a slag area of the foil is formed which now can be pulled through the slot 15 in FIG. 3 to the right in such a manner that the foil is pulled around the front edges of the guide faces 13 and 14 which limit slot 15, on the one hand, and the front edge of the end piece 14', on the other hand. Thereby, the semihose is forcibly formed with a cross section illustrated in FIG. 2, which subsequently is further moved in a horizontal direction through the device (see FIG. 3).

A guide bar 16 is provided for an improved feeding of the foil through slot 15 which in the feeding direction of foil 8 is mounted in front of the mold shoulder device 11 and protrudes selfsupporting at the lower end of the slot 5 in the horizontal direction.

As a drive for the forward moving of the foil or the semihose upper and lower pairs of belts 17 and 18 are provided which rotate on guide rollers 19 which are mounted in such a manner that the upper pair of belts 17 grip the area of the bag fold 3 which is adjacent to the label fold 2 and the lower pair of belts 18 grip the adjacent area of the bag fold 3 and let it move forward by means of friction locking toward the right by driving the guide rollers 19 as can be seen in FIGS. 3 and 4.

An inserting trough 20 is provided for inserting the labels 6 into the label fold 2 being formed by the end piece 14' of the mold shoulder 11 which penetrates the slot 15 parallel to the guide bar 16 from a label magazine 21 at the lower end of the end piece 14' to the proximity of a light barrier 22. The labels 6 are fed forward to the right in the trough 20 by means of a pneumatically driven plunger 23 during an interrupted movement of the foil or the semihose (the guide rollers 19 and the pair of belts 17 and 18 are idle), as can be seen in FIGS. 3 and 4, until the front edge of the label 6 in the forward movement direction interrupts the light path of the light barrier 22. Now, the plunger 23 remains stationary or returns for gripping the next label, while the forward movement of the foil 8 or the semihose is switched on, so that the label 6 which is present in the transfer position at the light barrier 22 is taken along by means of friction locking with the label fold. As soon as this taken along label releases the light barrier 22 again when moving with its rear edge passed the light path, the forward movement of the foil is again interrupted.

Now, a further label is fed forward to the transfer position, i.e., into a position whereby the front edge of this label interrupts the light path of the light barrier 22.

During the interruptions of the forward movement of the foil which is controlled by the light barrier 22, a separating weld die 24 is actuated for making the separating weld seams 4. Thereby, a separating weld die 25 is pressed against a stationary counter die 27 covered with silicon rubber until the given separating weld seams 4 are made and the separation of the bag fold 3 is accomplished between these seams 4 (see FIG. 6).

Simultaneously, a pneumatic unit 28 activates a perforation knife 29 which is pressed against a perforation die 30 being covered with rubber. Thus the perforations 5 are made in continuation of the separating weld seams.

Due to the described control of the foil movement by means of the light barrier 22, the measurements of bags 1 in the forward moving direction are automatically adjusted to the corresponding length of the labels 6.

A punching device 31 is disposed behind the separating weld die 24 in the forward movement direction, with which the label fold 2 as well as the label 6 contained therein of each bag may be apertured for making a suspension opening or the like, if need be, (see FIG. 1).

This punching device 31 is displaceably disposed in the forward movement, so that the suspension opening may be made at any desired location, customarily at the center of the bag. The punching device 31, as well as the separating weld die 24 is actuated during the interrupted forward movement of foil 8, whereby the switching on of the punching device 31 can be performed by the light barrier, directly or indirectly.

A filling station 32 for filling the bags is disposed between the pairs of belts 17 and 18 in a manner illustrated in FIGS. 3 and 4. If need be, the filling station 32 may be displaced in the forward movement together with the pairs of belts 17 and 18, so as to adjust the position of the filling station 32 in such a manner that during the interrupted forward movement a bag is always positioned within the filling station 32.

A curved guide sheet metal 32 with contact pressure rollers 34 is disposed on the filling station 32 in such a manner that the label fold 2 moves between the guide sheet metal and the pressure rollers 34 without the bag fold 3 being reached by the guide sheet metal 33. Thereby, the guide sheet metal 33 is mounted with its convex side on the left side of the label fold 2 as shown in FIG. 2, so that the same is displaced to the right (in FIG. 2). Thereby, the free edge of the bag fold 3 tries to lift off from the label fold 2, so that a bag opening 35 is formed which is schematically illustrated in FIG. 4. In addition, an air flow is directed from above towards the free end of the bag fold 3 by means of a blower 36, so that the bag opening is forcibly opened or maintained in an open position, since the air flow tries to blow up the bag. The goods to be introduced into the bag may be performed by a supply or portioning device, not shown.

After passing the filling station 32, the bags or the web of bags move through a seal weld device 37, whose movable dies are actuated by means of a pneumatic unit 38 for making the seal weld seam 7 illustrated in FIGS. 1 and 2.

Now, the filled and closed bags have to be separated from each other. For this purpose a bag separator 39 is used with pneumatically actuated clamping jaws 40 which are able to retain the web of bags in front of and behind a perforation 5, so that a simultaneously actuated separating slide 41 can cut the perforation 5.

Now, the separated and filled bags may be fed to a transport container (not shown), or the like.

I claim:

1. A device for making and filling bags, comprising means for supplying an elongated plastic foil; means for moving and folding the plastic foil and including a mold with a mold shoulder such that the foil is pulled over the mold shoulder and forms a semi-hose with two opposing U-folds forming upper and lower edges of the bags and including a label fold and a bag fold, each having a free edge overlapping one another so that the label fold is covered from outside by the free edge of the bag fold; means for inserting labels and including a label feeding member which moves synchronously with the semihose and inserts labels into the label fold through an opening in the semihose; means for separating bags and including a separating weld die which forms separating weld seams extending behind each inserted label over a total width of the bag fold and partially into an area of the label fold so as to leave intact a partial width of the label fold; means for filling the bag folds while the bags are still connected with one another by the partial width of the label folds; and means for closing the bags and including a weld die which forms a seal weld in the region remote from a bottom of the bag fold and a top of the label fold so that the top of the label fold and the bottom of the bag fold do not have any seams.

2. A device as defined in claim 1; and further comprising means for providing perforations and including a perforating tool making perforations in the partial width of the label fold behind each inserted label, said separating weld die operating synchronously with the perforating tool and the latter being disposed as a continuation of the separating weld die in the area of the partial width of the label fold so that the partial width of the label fold is free from the separating weld die to allow the perforating tool to make linear-like perforations which form a continuation of the separating weld seam.

3. A device as defined in claim 2, wherein said perforating tool is formed as a perforating die.

4. A device as defined in claim 1, wherein said label feeding member is formed so that the labels are displaceable by the label feeding member from a position outside of the semihose into a transfer position within the semihose, from which the labels are taken along under the action of friction locking with the label fold during moving of the semihose.

5. A device as defined in claim 4, wherein said label feeding member includes a trough arranged to encompass a label edge and a plunger which is guided parallel to the trough and displaces the labels into the transfer position.

6. A device as defined in claim 4; and further comprising means for controlling a cycle-like movement of the semihose and including a light barrier arranged behind the transfer position as considered in direction of movement, said light barrier being formed so that when a rear edge of a label passes the light barrier and releases it the movement of the semihose is interrupted and the separating welding die is actuated for making the separating weld seam, and when a front edge of a following label again interrupts the light barrier the movement of the semihose is actuated for moving the semihose into the transfer position.

7. A device as defined in claim 1; and further comprising a path guiding element, said filling means including a filling station having a curved path with a curved center located at a side facing the free edges of the U-folds so that when the semihose is fed to the filling station the free edge of the bag fold is lifted off due to the curved path, while the guiding element presses the free edge of the label fold against the label without gripping the free edge of the bag fold.

8. A device as defined in claim 6; and further comprising a blower arranged in the filling station so that it blows in a direction away from the label fold and against the free edge of the bag fold.

9. A device as defined in claim 1; and further comprising a punch means arranged behind the separating weld die as considered in direction of moving of the semihose so as to make an opening by penetrating the label fold and the label.

10. A device for making and filling bags, comprising means for supplying an elongated plastic foil; means for moving and folding the plastic foil and including a mold with a mold shoulder such that the foil is pulled over the mold shoulder and forms a semihose with two opposing U-folds forming upper and lower edges of the bags and including a label fold and a bag fold, each having a free edge overlapping one another so that the label fold is covered from outside by the free edge of the bag fold; means for inserting labels and including a label feeding member which moves synchronously with the semihose and inserts labels into the label fold through an opening in the semihose, said label feeding member being formed so that the labels are displaceable by the label feeding member from a position outside of the semihose into a transfer position within the semihose, from which the labels are taken along under the action of friction locking with the label fold during moving of the semihose; means for separating bags and including a separating weld die which forms separating weld seams extending behind each inserted label over a total width of the bag fold and partially into an area of the label fold so as to leave intact a partial width of the label fold; means for filling the bag folds while the bags are still connected with one another by the partial width of the label folds, said filling means including a path guiding element and a filling station having a curved path with a curved center located at a side facing the free edges of the U-folds so that when the semihose is fed to the filling station the free edge of the bag fold is lifted off due to the curved path, while the guiding element presses the free edge of the label fold against the label without gripping the free edge of the bag fold.

* * * * *